US007880533B2

(12) United States Patent
Marinca

(10) Patent No.: US 7,880,533 B2
(45) Date of Patent: Feb. 1, 2011

(54) BANDGAP VOLTAGE REFERENCE CIRCUIT

(75) Inventor: Stefan Marinca, Dooradoyle (IE)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 12/054,875

(22) Filed: Mar. 25, 2008

(65) Prior Publication Data

US 2009/0243708 A1 Oct. 1, 2009

(51) Int. Cl.
*G05F 3/02* (2006.01)

(52) U.S. Cl. ..... 327/539

(58) Field of Classification Search ..... None
See application file for complete search history.

(56) References Cited

U.S. PATENT DOCUMENTS

| | | | | |
|---|---|---|---|---|
| 4,399,398 | A | 8/1983 | Wittlinger | |
| 4,475,103 | A | 10/1984 | Brokaw et al. | |
| 4,603,291 | A | 7/1986 | Nelson | |
| 4,714,872 | A | 12/1987 | Traa | |
| 4,800,339 | A * | 1/1989 | Tanimoto et al. | 330/253 |
| 4,808,908 | A | 2/1989 | Lewis et al. | |
| 4,939,442 | A | 7/1990 | Carvajal et al. | |
| 5,053,640 | A | 10/1991 | Yum | |
| 5,119,015 | A | 6/1992 | Watanabe | |
| 5,229,711 | A | 7/1993 | Inoue | |
| 5,325,045 | A | 6/1994 | Sundby | |
| 5,352,973 | A | 10/1994 | Audy | |
| 5,371,032 | A * | 12/1994 | Nishihara | 438/152 |
| 5,424,628 | A | 6/1995 | Nguyen | |

(Continued)

FOREIGN PATENT DOCUMENTS

| | | |
|---|---|---|
| EP | 0510530 | 10/1992 |

(Continued)

OTHER PUBLICATIONS

PCT/EP2008/067402 International Search Report, Mar. 20, 2009.

(Continued)

*Primary Examiner*—Lincoln Donovan
*Assistant Examiner*—Khareem E Almo
(74) *Attorney, Agent, or Firm*—Kenyon & Kenyon LLP

(57) ABSTRACT

A bandgap voltage reference circuit which provides a bandgap reference voltage without requiring a resistor. The circuit comprises an amplifier having an inverting input, a non-inverting input and an output. First and second bipolar transistors are provided which operate at different current densities each coupled to a corresponding one of the inverting and non-inverting inputs of the amplifier. A load MOS transistor of a first aspect ratio is driven by the amplifier to operate in the triode region with a corresponding drain-source resistance $r_{on}$. The load MOS device is operably coupled to the second bipolar transistor such that a base-emitter difference ($\Delta V_{be}$) resulting from the collector current density difference between the first and second bipolar transistors is developed across the drain-source resistance $r_{on}$, of the load MOS device. A cascoded MOS device of a second aspect ratio is operably coupled to the load MOS device and is driven by the amplifier to operate in the triode region. The first and second aspect ratios are such that that the drain-source voltage of the second MOS transistor ($V_{ds2}$) is a scaled representation of the base-emitter voltage difference ($\Delta V_{be}$).

23 Claims, 3 Drawing Sheets

U.S. PATENT DOCUMENTS

| | | | | |
|---|---|---|---|---|
| 5,512,817 | A | 4/1996 | Nagaraj | |
| 5,563,504 | A | 10/1996 | Gilbert et al. | |
| 5,646,518 | A | 7/1997 | Lakshmikumar et al. | |
| 5,821,807 | A | 10/1998 | Brooks | |
| 5,828,329 | A | 10/1998 | Burns | |
| 5,933,045 | A | 8/1999 | Audy et al. | |
| 5,952,873 | A | 9/1999 | Rincon-Mora | |
| 5,982,201 | A | 11/1999 | Brokaw et al. | |
| 6,002,293 | A | 12/1999 | Brokaw | |
| 6,075,354 | A | 6/2000 | Smith et al. | |
| 6,157,245 | A | 12/2000 | Rincon-Mora | |
| 6,218,822 | B1 | 4/2001 | MacQuigg | |
| 6,225,796 | B1 | 5/2001 | Nguyen | |
| 6,255,807 | B1 | 7/2001 | Doorenbos et al. | |
| 6,329,804 | B1 | 12/2001 | Mercer | |
| 6,329,868 | B1 | 12/2001 | Furman | |
| 6,356,161 | B1 | 3/2002 | Nolan et al. | |
| 6,362,612 | B1 * | 3/2002 | Harris | 323/312 |
| 6,373,330 | B1 | 4/2002 | Holloway | |
| 6,426,669 | B1 | 7/2002 | Friedman et al. | |
| 6,462,625 | B2 | 10/2002 | Kim | |
| 6,483,372 | B1 | 11/2002 | Bowers | |
| 6,489,787 | B1 | 12/2002 | McFadden | |
| 6,489,835 | B1 | 12/2002 | Yu et al. | |
| 6,501,256 | B1 | 12/2002 | Jaussi et al. | |
| 6,529,066 | B1 | 3/2003 | Guenot et al. | |
| 6,531,857 | B2 | 3/2003 | Ju | |
| 6,549,072 | B1 * | 4/2003 | Vernon | 330/252 |
| 6,590,372 | B1 | 7/2003 | Wiles, Jr. | |
| 6,614,209 | B1 | 9/2003 | Gregoire, Jr. | |
| 6,642,699 | B1 | 11/2003 | Gregoire, Jr. | |
| 6,661,713 | B1 | 12/2003 | Kuo | |
| 6,664,847 | B1 | 12/2003 | Ye | |
| 6,690,228 | B1 | 2/2004 | Chen et al. | |
| 6,791,307 | B2 | 9/2004 | Harrison | |
| 6,798,286 | B2 | 9/2004 | Dauphinee et al. | |
| 6,801,095 | B2 * | 10/2004 | Renninger, II | 331/57 |
| 6,828,847 | B1 | 12/2004 | Marinca | |
| 6,836,160 | B2 | 12/2004 | Li | |
| 6,853,238 | B1 | 2/2005 | Dempsey et al. | |
| 6,885,178 | B2 | 4/2005 | Marinca | |
| 6,891,358 | B2 | 5/2005 | Marinca | |
| 6,894,544 | B2 | 5/2005 | Gubbins | |
| 6,919,753 | B2 | 7/2005 | Wang et al. | |
| 6,930,538 | B2 | 8/2005 | Chatal | |
| 6,958,643 | B2 | 10/2005 | Rosenthal | |
| 6,987,416 | B2 | 1/2006 | Ker et al. | |
| 6,992,533 | B2 | 1/2006 | Hollinger et al. | |
| 7,012,416 | B2 | 3/2006 | Marinca | |
| 7,057,444 | B2 | 6/2006 | Illegems | |
| 7,068,100 | B2 | 6/2006 | Dauphinee et al. | |
| 7,088,085 | B2 | 8/2006 | Marinca | |
| 7,091,761 | B2 | 8/2006 | Stark | |
| 7,112,948 | B2 | 9/2006 | Daly et al. | |
| 7,170,336 | B2 | 1/2007 | Hsu | |
| 7,173,407 | B2 | 2/2007 | Marinca | |
| 7,193,454 | B1 | 3/2007 | Marinca | |
| 7,199,646 | B1 | 4/2007 | Zupcau et al. | |
| 7,211,993 | B2 | 5/2007 | Marinca | |
| 7,224,210 | B2 | 5/2007 | Garlapati et al. | |
| 7,236,047 | B2 | 6/2007 | Tachibana et al. | |
| 7,248,098 | B1 | 7/2007 | Teo | |
| 7,260,377 | B2 | 8/2007 | Burns et al. | |
| 7,301,321 | B1 | 11/2007 | Uang et al. | |
| 7,372,244 | B2 | 5/2008 | Marinca | |
| 7,411,380 | B2 | 8/2008 | Chang et al. | |
| 7,472,030 | B2 | 12/2008 | Scheuerlein | |
| 7,482,798 | B2 | 1/2009 | Han | |
| 2003/0234638 | A1 | 12/2003 | Aria et al. | |
| 2005/0073290 | A1 | 4/2005 | Marinca et al. | |
| 2005/0194957 | A1 | 9/2005 | Brokaw | |
| 2005/0237045 | A1 | 10/2005 | Lee et al. | |
| 2006/0017457 | A1 | 1/2006 | Pan et al. | |
| 2006/0038608 | A1 | 2/2006 | Ozawa | |
| 2007/0176591 | A1 | 8/2007 | Kimura | |
| 2008/0018319 | A1 | 1/2008 | Chang et al. | |
| 2008/0074172 | A1 | 3/2008 | Marinca | |
| 2008/0224759 | A1 | 9/2008 | Marinca | |
| 2008/0265860 | A1 | 10/2008 | Dempsey et al. | |

FOREIGN PATENT DOCUMENTS

| | | | |
|---|---|---|---|
| EP | 1359490 | A2 | 11/2003 |
| EP | 1359490 | A3 | 11/2003 |
| JP | 4-167010 | | 6/1992 |
| KR | 0115143 | | 12/2007 |
| WO | WO 2004/007719 | | 2/2004 |

OTHER PUBLICATIONS

PCT/EP2008/058685 International Search Report and written opinion, Oct. 1, 2008.

PCT/EP2008/051161 International Search Report and written opinion, May 16, 2008.

Chen, Wai-Kai, "The circuits and filters handbook", 2nd ed, CRC Press, 2003.

Cressler, John D., "Silicon Heterostructure Handbook", CRC Press-Taylor & Francis Group, 2006; 4.4-427-438.

Gray, Paul R., et al, *Analysis and Design of Analog Integrated Circuits*, Chapter 4, 4th ed., John Wiley & Sons, Inc., 2001, pp. 253-327.

PCT/EP2005/052737 International Search Report, Sep. 23, 2005.

Banba et al, "A CMOS bandgap reference circuit with Sub-1-V operation", IEEE JSSC vol. 34, No. 5, May 1999, pp. 670-674.

Brokaw, A. Paul, "A simple three-terminal IC bandgap reference", IEEE Journal of Solid-State Circuits, vol. SC-9, No. 6, Dec. 1974, pp. 388-393.

Jones, D.A., and Martin, K., "Analog Integrated Circuit Design", John Wiley & Sons, USA, 1997 (ISBN 0-47L-L4448-7, pp. 353-363).

Malcovati et al, "Curvature-compensated BiCMOS bandgap with 1-V supply voltage", IEEE JSSC, vol. 36, No. 7, Jul. 2001.

Sudha et al, "A low noise sub-bandgap voltage reference", IEEE, Proceedings of the 40th Midwest Symposium on Circuits and Systems, 1997. vol. 1, Aug. 3-6, 1997, pp. 193-196.

Widlar, Robert J., "New developments in IC voltage regulators", IEEE Journal of Solid-State Circuits, vol. SC-6, No. 1, Feb. 1971, pp. 2-7.

Jianping, Zeng, et al, "CMOS Digital Integrated temperature Sensor", IEEE, Aug. 2005, pp. 310-313.

PCT/EP2008/067403, International Search Report and Written Opinion, Apr. 27, 2009.

Pease, R.A., "The design of band-gap reference circuits: trials and tribulations", IEEE 1990 Bipolar circuits and Technology Meeting 9.3, Sep. 17, 1990, pp. 214-218.

* cited by examiner

PRIOR ART

BANDGAP VOLTAGE REFERENCE CIRCUIT

FIELD OF THE INVENTION

The present invention relates to a bandgap voltage reference circuit. The invention more particularly relates to a bandgap voltage reference circuit which does not require a resistor.

BACKGROUND

Bandgap voltage reference circuits are well known in the art. Such circuits are designed to sum two voltages with opposite temperature slopes. One of the voltages is a Complementary-To-Absolute Temperature (CTAT) voltage typically provided by a base-emitter voltage of a forward biased bipolar transistor. The other is a Proportional-To-Absolute Temperature (PTAT) voltage typically derived from the base-emitter voltage differences of two bipolar transistors operating at different collector current densities. When the PTAT voltage and the CTAT voltage are summed together the summed voltage is at a first order temperature insensitive.

An example of a prior art bandgap voltage reference 100 is illustrated in FIG. 1. Such a circuit is typical of prior art arrangements and requires two resistors. The bandgap voltage reference circuit 100 includes a first substrate PNP bipolar transistor Q1 operating at a first collector current density and a second substrate PNP bipolar transistor Q2 operating at a second collector current density which is less than that of the first collector current density. The emitter of the first bipolar transistor Q1 is coupled to the inverting input of an operational amplifier A and the emitter of the second bipolar transistor Q2 is coupled via a resistor $r_1$ to the non-inverting input of the amplifier A. The collector current density difference between Q1 and Q2 may be established by having the emitter area of the second bipolar transistor Q2 larger than the emitter area of the first bipolar transistor Q1. Alternatively multiple transistors may be provided in each leg, with the sum of the collector currents of each of the transistors in a first leg being greater than that in a second leg. As a consequence of the differences in collector current densities between the bipolar transistors Q1 and Q2 a base-emitter voltage difference ($\Delta V_{be}$) is developed across the resistor $r_1$.

$$\Delta V_{be} = \frac{kT}{q}\ln(n) \tag{1}$$

Where:

k is the Boltzmann constant, q is the charge on the electron,

T is the operating temperature in Kelvin, n is the collector current density ratio of the two bipolar transistors.

A PTAT current, $I_{PTAT}$, is generated as a result of the voltage difference $\Delta V_{be}$ dropped across $r_1$.

$$I_{PTAT} = \frac{\Delta V_{be}}{r_1} \tag{2}$$

A current mirror arrangement comprising three PMOS transistors MP1, MP2 and MP3 of similar or different aspect ratios are driven by the output of the amplifier A to mirror the PTAT current $I_{PTAT}$. It will be appreciated by those skilled in the art that the collector current density difference between Q1 and Q2 can also be achieved by having the aspect ratio (related to the Width/Length (W/L) of the MOS device) of MP1 greater than the aspect ratio (W/L) of MP2 so that the drain current of MP1 is greater than the drain current of MP2.

A third PNP bipolar transistor $Q_3$ is coupled to a voltage reference output node ref via a resistor $r_2$. The PMOS transistor MP3 mirrors the PTAT current IPTAT derived from the emitter voltage difference ($\Delta V_{be}$) developed across the resistor $r_1$. The PTAT current provided by MP3 flows to the emitter of the third bipolar transistor Q3 through resistor $r_2$. The voltage at the output node ref is equal to the summation of the base emitter voltage $V_{be}$ of the third bipolar transistor Q3 plus the base emitter voltage difference $\Delta V_{be}$ resulting from the PTAT current $I_{PTAT}$ flowing through $r_2$.

$$V_{ref} = V_{be}(Q3) + I_{PTAT} * r_2 = V_{be}(Q3) + \Delta V_{be} * \frac{r_2}{r_1} \tag{3}$$

Accordingly, the voltage reference $V_{ref}$ at node ref is dependent on the resistance of resistors $r_1$ and $r_2$. For a specific current density ratio, n, and a corresponding resistor ratio, $r_2/r_1$, the reference voltage is substantially temperature insensitive.

It will be understood that when providing circuits in silicon that different circuit elements will occupy different amounts of the available silicon substrate. For low power applications resistors typically occupy relative large areas. From a review of FIG. 1, it is apparent that the bandgap voltage reference circuit 100 requires two resistors $r_1$, $r_2$. These elements will occupy a large silicon area which is undesirable for low power voltage designs.

As well as occupying large areas on the silicon, those skilled in the art will appreciate that resistors suffer in their sensitivity to process variations in that the resistance of resistors may vary from lot to lot of the order of +/−20%. Such resistance variation of the resistors $r_1$ and $r_2$ results in a corresponding PTAT current $I_{PTAT}$ variation and hence a reference voltage $V_{ref}$ variation.

There is therefore a need to provide a bandgap voltage reference which may be implemented using a reduced silicon area than for prior art arrangements. Such a reference could be used for low power applications and should exhibit less sensitivity to process variation.

SUMMARY

These and other problems are addressed in accordance with the teaching of the present invention by providing a bandgap voltage reference circuit incorporating a MOS device operating in the triode region with a corresponding drain-source resistance $r_{on}$. The drain-source resistance $r_{on}$ of MOS devices are less sensitive to semiconductor process variations compared to resistors. A PTAT current required for the generation of the voltage reference is generated by providing a base-emitter voltage difference $\Delta V_{be}$ across the drain-source of the MOS device.

These and other features will be better understood with reference to the followings Figures which are provided to assist in an understanding of the teaching of the invention.

BRIEF DESCRIPTION OF THE DRAWINGS

The present application will now be described with reference to the accompanying drawings in which.

DETAILED DESCRIPTION OF THE DRAWINGS

The invention will now be described with reference to some exemplary bandgap voltage reference circuits which are provided to assist in an understanding of the teaching of the invention. It will be understood that these circuits are provided to assist in an understanding and are not to be construed as limiting in any fashion. Furthermore, circuit elements or components that are described with reference to any one Figure may be interchanged with those of other Figures or other equivalent circuit elements without departing from the spirit of the present invention.

Figure 1:
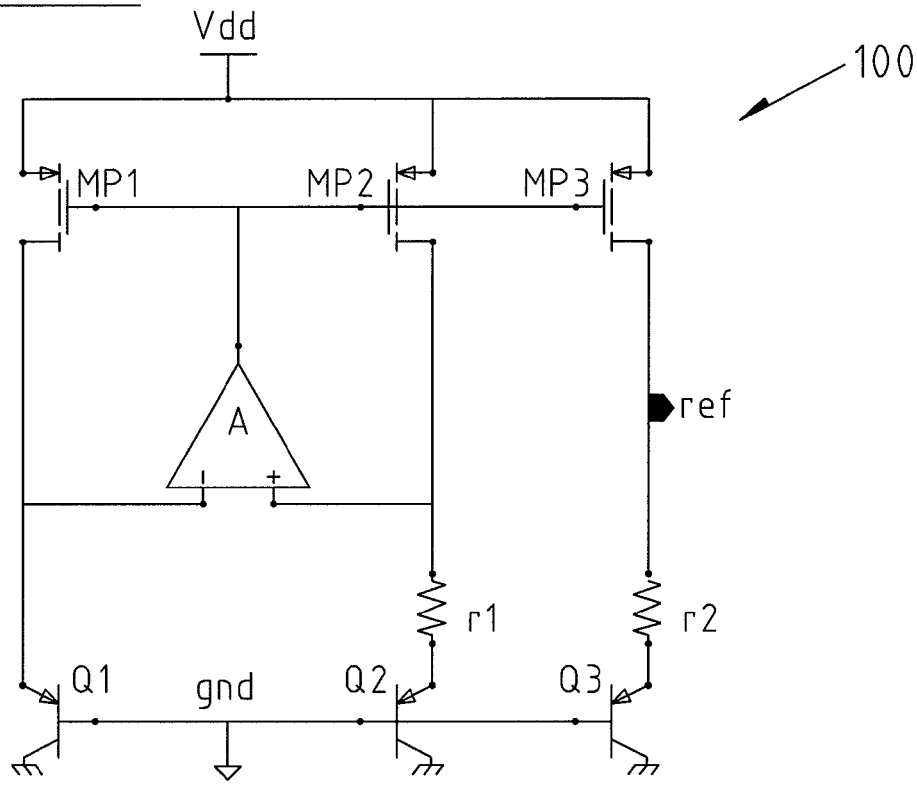
FIG. 1 is a schematic circuit diagram of a prior art bandgap voltage reference circuit.
Figure 2:
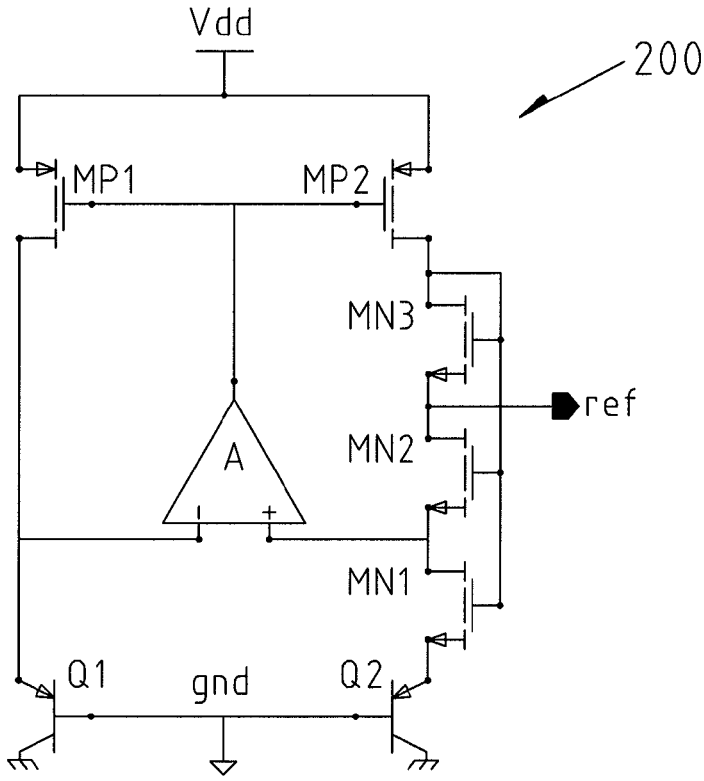
FIG. 2 is a schematic circuit diagram of a circuit provided in accordance with the teaching of the present invention.

Referring to the drawings and initially to FIG. 2 there is illustrated a bandgap voltage reference circuit 200 which generates a bandgap reference voltage without using a resistor in accordance with the teaching of the present invention. The circuit 200 comprises a first PNP bipolar transistor Q1 operating at a first collector current density and a second PNP bipolar transistor Q2 operating at a second collector current density which is less than that of the first collector current density. The emitter of the first bipolar transistor Q1 is coupled to the inverting input of an operational amplifier A and the emitter of the second bipolar transistor Q2 is coupled via a load NMOS device MN1 to the non-inverting input of the amplifier A. The source of the load NMOS transistor MN1 is coupled to the emitter of the second bipolar transistor Q2 and the drain of MN1 is coupled to the non-inverting input of the amplifier A. The bases and collectors of both PNP bipolar transistors Q1, Q2 are coupled to a ground node gnd.

The output of the amplifier A drives a current mirror arrangement comprising two PMOS transistors namely, MP1, MP2 which mirror the PTAT current generated by the voltage drop across the drain-source of MN1, as will be described below. The PMOS transistors MP1, MP2 are of similar aspect ratios with their sources coupled to a power supply Vdd and their gates coupled together so that they are biased to provide the same drain currents.

Two cascoded NMOS transistors MN2 and MN3 are coupled between the drains of the load NMOS transistor MN1 and the second PMOS transistor MP2. The gates of the three NMOS transistors MN1, MN2 and MN3 are coupled to the drain of MP2. Thus, the NMOS transistor MN3 is provided in a diode configuration and operates in the saturation region.

The load NMOS transistor MN1 operates in the triode region, and may be constructed by connecting a plurality 'm' of unity stripe NMOS transistor in parallel. The second NMOS transistor MN2 also operates in the triode region and comprises a single unity stripe NMOS transistor. The bandgap reference voltage is available from an output node, ref, common to the source of MN3 and the drain of MN2.

The collector current density difference between Q1 and Q2 may be established by having the emitter area of the second bipolar transistor Q2 larger than the emitter area of the first bipolar transistor Q1. In an alternative arrangement, multiple transistors may be provided in each leg, with the sum of the collector currents of each of the transistors in a first leg being greater than that in a second leg. It will be appreciated by those skilled in the art that the collector current density difference between Q1 and Q2 can also be achieved by having the aspect ratio (Width/Length (W/L) of the MOS device) of MP1 greater than the aspect ratio (W/L) of MP2 so that the drain current of MP1 is greater than the drain current of MP2. The collector current density difference between Q1 and Q2 may be achieved in any one of a number of different ways and it is not intended to limit the teaching of the present invention to any one specific arrangement. Irrespective of the technique used for fabricating the collector current differences, as a consequence of these differences in collector current densities between the bipolar transistors Q1 and Q2, a base-emitter voltage difference ($\Delta V_{be}$) is developed across the drain-source resistance $r_{on}$ of the load NMOS device MN1.

In operation, the load transistor MN1 and the cascoded transistor MN2 are biased to provide the same drain current but have different aspect ratios. The difference in the aspect ratios between the load transistor MN1 and the cascoded transistor MN2 is translated to a difference in voltage drop across their respective drain-sources.

A PTAT current is provided by the drain current of MP2 which flows to the drains of the three NMOS transistors MN1, MN2, and MN3:

$$I_{PTAT} = \frac{\Delta V_{be}}{r_{on}} \tag{4}$$

As the load NMOS transistor MN1 is constructed from 'm' unity stripe NMOS transistors the drain current of MN1 may be expressed by equation 5.

$$\begin{aligned} I_{PTAT} &= \frac{\Delta V_{be}}{r_{on}} \\ &= m * \beta * \left(V_{gs1} - V_t - \frac{V_{ds1}}{2}\right) * V_{ds1} \\ &= m * \beta * \left(V_{gs1} - V_t - \frac{\Delta V_{be}}{2}\right) * \Delta V_{be} \end{aligned} \tag{5}$$

Where:

β is the MOS transistor parameter;

m is the number of identical stripes, parallel connected;

$V_{gs1}$ is the gate-source voltage of MN1,

Vds1 is the drain-source voltage of MN1 which is equal to base-emitter voltage difference, $\Delta V_{be}$, $V_t$, is the threshold voltage.

The MOS transistor's β parameter in the triode region is given by equation 6.

$$\beta = \mu * C_{ox} * \frac{W}{L} = K_n * \frac{W}{L} \tag{6}$$

Where:

μ is the charge carrier's mobility in the channel, $C_{ox}$ is the oxide capacitance per unit area, W/L are the MOS transistor's aspect ratio.

From equation (5) we can extract:

$$V_{gs1} - V_t = \frac{1}{r_{on} * m * \beta} + \frac{\Delta V_{be}}{2} \tag{7}$$

As the second NMOS transistor MN2 operates in the triode region, its gate-source voltage is less that gate-source voltage of MN1 by $\Delta V_{be}$. MN2 is a single unity stripe NMOS transistor and its drain current is given by equation 8.

$$\begin{aligned} I_{PTAT} &= \frac{\Delta V_{be}}{r_{on}} \\ &= \beta * \left(V_{gs1} - \Delta V_{be} - V_t - \frac{V_{ds2}}{2}\right) * V_{ds2} \\ &= \beta * \left(\frac{1}{m * \beta * r_{on}} - \frac{\Delta V_{be}}{2} - \frac{V_{ds2}}{2}\right) * V_{ds2} \end{aligned} \tag{8}$$

Where:

$V_{ds1}$ is the drain-source voltage of MN1, and $V_{ds2}$ is the drain-source voltage of MN2.

If the β parameter of each of the transistors MN1 and MN1 is very low as a result of relatively small aspect ratios (W/L) the following approximation can be made.

$$\frac{1}{m * \beta * r_{on}} >> \frac{\Delta V_{be} + V_{ds2}}{2} \tag{9}$$

The approximation of equation 9 can be set via the MOS transistor aspect ratio (W/L).

In this exemplary arrangement, the bandgap voltage reference circuit 200 is fabricated using a submicron CMOS process with $K_n$=30 μA/V$^2$. The drain current from MP2 is 1 μA, and MN1 comprises four unity stripe NMOS transistors. The base-emitter voltage difference $\Delta V_{be}$ is 100 mV and $\Delta V_{be}$ plus $V_{ds2}$ is 550 mV. Additionally, the aspect ratio W/L of equation (9) is 1/30, which corresponds to 3.3% approximation. Using these values, it is possible to equate a relationship, such as that set forth in equation 10.

$$\left(\frac{\Delta V_{be} + V_{ds2}}{2}\right) * m * K_n * \frac{W}{L} * \frac{\Delta V_{be}}{I_d} = \frac{1}{30} \tag{10}$$

From equation (10):

$$\begin{aligned} \frac{W}{L} &= \frac{1}{30 * \left(\frac{\Delta V_{be} + V_{ds2}}{2}\right) * m * K_n * \frac{\Delta V_{be}}{I_d}} \\ &= \frac{1}{30 * 0.275\ \text{V} * 4 * 30\ \mu\text{A/V}^2 * \frac{0.1\ \text{V}}{1\ \mu\text{A}}} \\ &\cong 0.01 \end{aligned} \tag{11}$$

A practical choice for the dimensions of the MOS devices can be W=1 μm, L=100 μm. If equation (9) is true then the drain source voltage of MN2 $V_{ds2}$ is a scaled replica of base-emitter voltage difference.

$$V_{ds2} = m * \Delta V_{be} \tag{12}$$

As a result, if the offset voltage of the amplifier A is neglected, the drain voltage of MN2 is given by equation (13).

$$V_{ref} = V_{be}(Q1) + \Delta V_{be} * (m+1) \tag{13}$$

For a particular value of 'm' the two terms in equation (13) are balanced such that the reference voltage $V_{ref}$ is to a first order temperature insensitive. As equation (13) shows the reference voltage $V_{ref}$ is independent of MOS transistors parameters, except their stripe number ratio, 'm'.

Figure 3:
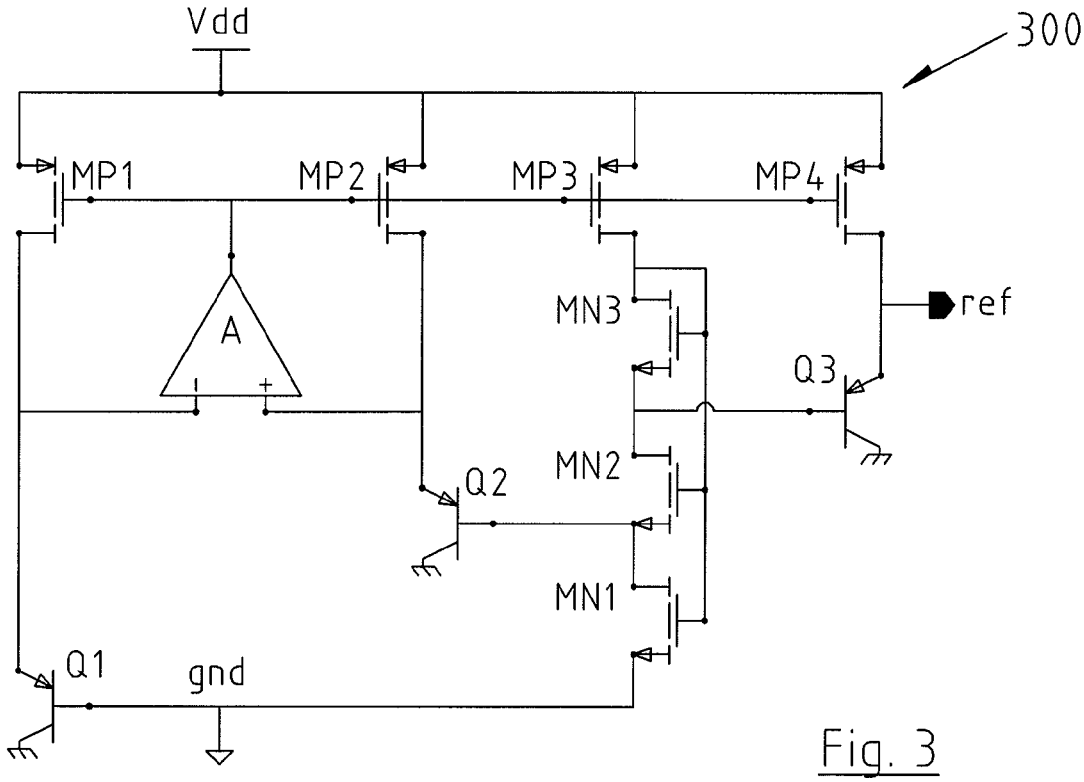
FIG. 3 is a schematic circuit diagram of a circuit provided in accordance with the teaching of the present invention.

Referring now to FIG. 3, there is illustrated another bandgap voltage reference circuit 300 which generates a bandgap voltage reference without using a resistor in accordance with the teaching of the present invention. The bandgap voltage reference circuit 300 is substantially similar to the bandgap voltage reference circuit 200, and like components are identified by the same reference labels. The circuit 300 may operate from a lower power supply Vdd compared to the circuit 200 as the load transistor MN1 is not cascoded on the second bipolar transistor Q2. The main difference between the circuit 300 and the circuit 200 is that the emitter of the second bipolar transistor Q2 is directly coupled to the non-inverting input of the amplifier A. The drain of the load NMOS transistor MN1 and the source of the cascoded NMOS transistor MN2 are coupled to the base of the second bipolar transistor Q2. Two additional PMOS transistor current mirrors MP3 and MP4 of similar aspect ratio to MP1 and MP2 are also driven by the output of the amplifier A for providing bias current. The source of MP3 is coupled to the Vdd power supply, and its drain is coupled to the drain and gate of the diode configured cascoded NMOS transistor MN3. The source of MP4 is coupled to the Vdd power supply, and its drain is coupled to the emitter of a third bipolar PNP bipolar transistor Q3 which has its base coupled to a node common to the source of MN3 and the drain of MN2. The collector of the third bipolar transistor Q3 is connected to ground. The output node, ref, in this embodiment is common to the emitter of the third bipolar transistor Q3 and the drain of the fourth PMOS transistor MP4.

The operation of the circuit 300 is substantially similar to the operation of the circuit 200. A base-emitter voltage difference between the first bipolar transistor Q1 and the second bipolar transistor Q2, $\Delta V_{be}$, is developed across the drain-source of the load NMOS transistor MN1 which results in a PTAT current. The PTAT current is mirrored by each of the PMOS transistors MP1, MP2, MP3 and MP4. The first and second PMOS transistors MP1 and MP2 provides current to the emitters of the first and second bipolar transistors Q1 and Q2, respectively. The third PMOS transistor MP3 provides current to each of the NMOS transistors MN1, MN2, and MN3. The fourth PMOS transistor MP4 provides current to the emitter of the third bipolar transistor Q3. The reference voltage at the output node ref is the summation of the base-emitter voltage difference $\Delta V_{be}$ developed across the drain-source of the load NMOS transistor MN1 with the voltage drop across drain-source of MN2 and the base-emitter voltage (CTAT) of the third bipolar transistor Q3. Thus, the voltage at the output node ref is also given by equation (13) above.

Figure 4:
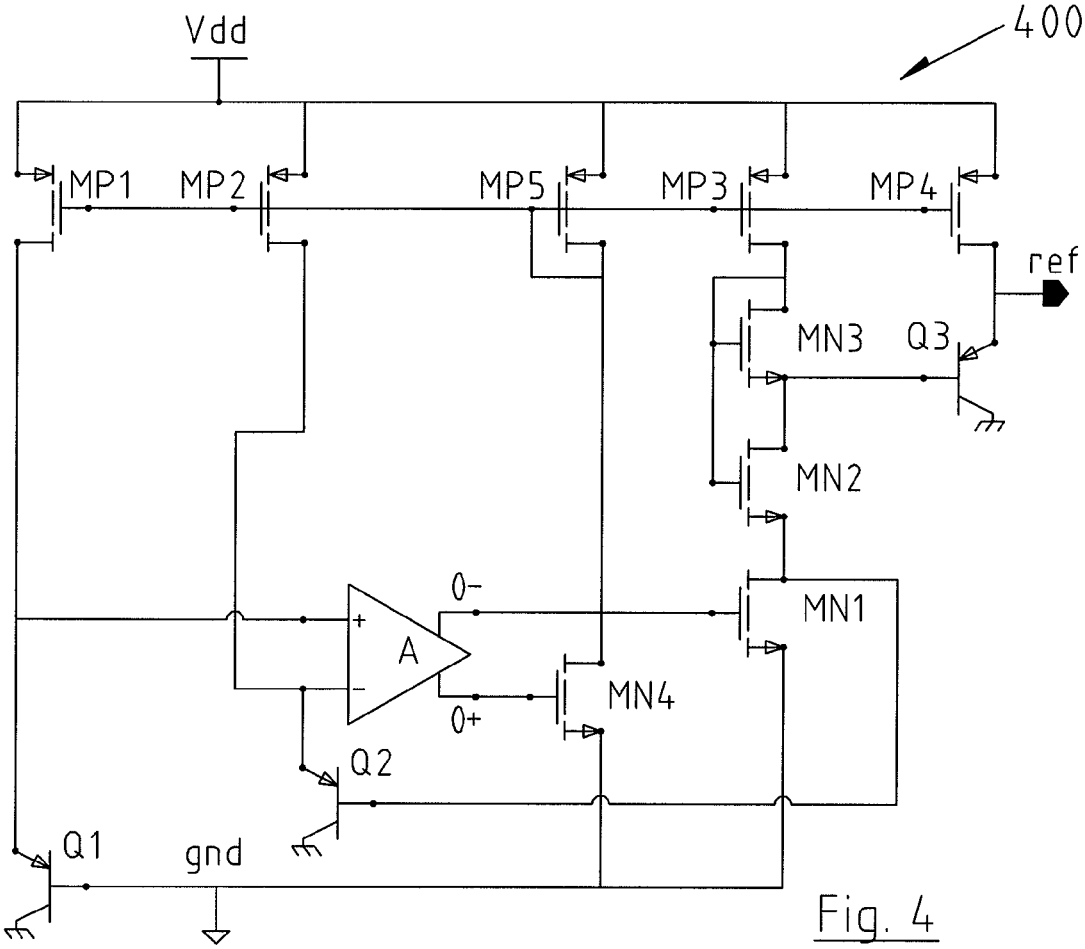
FIG. 4 is a schematic circuit diagram of a circuit provided in accordance with the teaching of the present invention.

Referring now to FIG. 4, there is illustrated another bandgap voltage reference circuit 400 which generates a bandgap voltage reference using a MOS device across which a base emitter voltage difference may be generated in accordance with the teaching of the present invention. The bandgap voltage reference circuit 400 is substantially similar to the bandgap voltage reference circuit 300, and like components are identified by the same reference labels. The main difference is that the amplifier A as well as having differential inputs also has differential outputs, namely, non-inverting output, o+, and inverting output, o−. Additionally, a fourth NMOS device MN4 is provided which has its gate driven by the non-inverting output of the amplifier A, o+, to generate feedback current. The source of MN4 is coupled to the ground node and its drain is coupled to a fifth PMOS transistor which is in a diode configuration with its source coupled to the Vdd power supply. In this embodiment, the gates of MP1, MP2, MP3 and MP4 are coupled to the gate of diode configured MP5. The gate of the load NMOS transistor MN1 is driven by the inverting output of the amplifier A. There are two negative feedback loops around the amplifier A. The first negative feedback loop with dominant gain is from the non-inverting output, o+, via MN4, MP5, and MP2 to the inverting input of the amplifier A. The second negative feedback loop with less gain than the first feedback loop is from the inverting output, o−, via MN1, Q2 to the inverting input of the amplifier A. Due to this double negative feedback the amplifier A is more stable compared to the amplifier of the circuit 300. Otherwise, the operation of the bandgap voltage reference circuit 400 is substantially similar to the operation of the bandgap voltage reference circuit 300. In particular, the bandgap reference voltage at the output node ref is the summation of the base-emitter voltage difference $\Delta V_{be}$ developed across the drain-source of the load NMOS transistor MN1 summed with the voltage drop across the drain source of MN2 and the base-emitter voltage (CTAT) of the third bipolar transistor Q3. Thus, the voltage at the output node ref is also given by equation (13) above.

It will be appreciated by those skilled in the art that while schematically shown as single transistors, that the bipolar transistors Q1 and Q2 can be implemented using a stack arrangement of bipolar transistors. In such a circuit a larger base-emitter voltage difference is reflected over the load transistor MN1 operating in triode region and a lower gain for the PTAT voltage is required.

Figure 5:
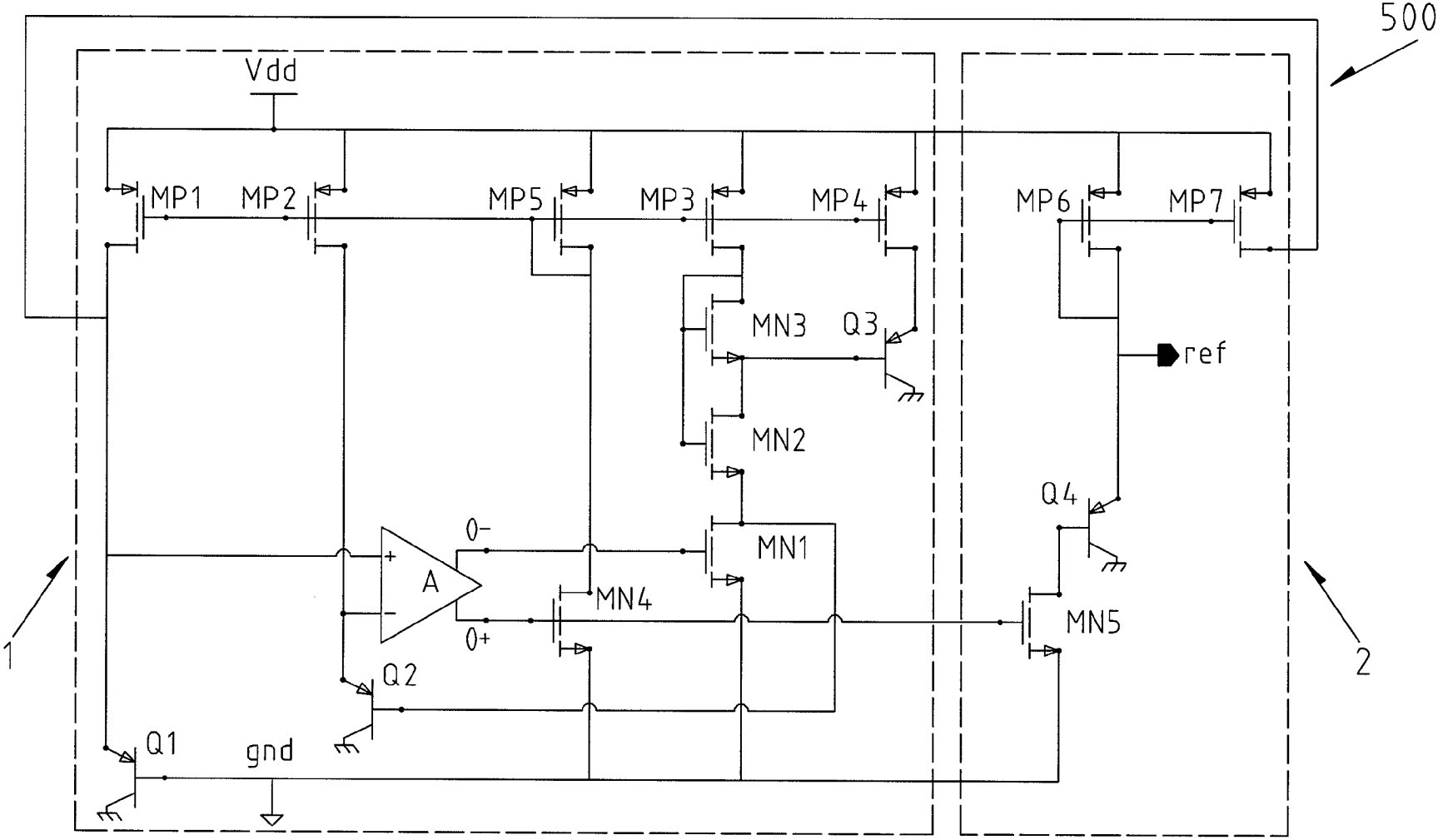
FIG. 5 is a schematic circuit diagram of a circuit provided in accordance with the teaching of the present invention.

Referring now to FIG. 5, there is illustrated another bandgap voltage reference circuit 500 which generates a bandgap voltage reference without using a resistor in accordance with the teaching of the present invention. The bandgap voltage reference circuit 500 is substantially similar to the bandgap voltage reference circuit 400, and like components are identified by the same reference labels. The portion of the circuit of FIG. 5 indicated by reference numeral 1 is substantially similar to the bandgap voltage reference circuit 400. The main difference between the circuit 500 and the circuit 400 is that the circuit 500 includes a compensation circuit indicated by reference numeral 2 which compensates for curvature error.

The compensation circuit 2 includes a fifth NMOS transistor MN5 which has its gate driven by the non-inverting output of the amplifier A so that its drain current provides additional linear PTAT bias current. A fourth PNP bipolar transistor Q4 has its base coupled to the drain of the fifth NMOS transistor MN5 and its collector coupled to ground receives the additional PTAT current from the drain of MN5 and transforms the PTAT current into a non-linear biasing current in the form of an emitter current with an inherent collector to base current ratio factor beta ($\beta_F$)

$$\beta_F(T) = \beta_{F0} * \left(\frac{T}{T_0}\right)^b \tag{14}$$

The emitter current of Q4 is an exponential current when $\beta>1$. The source current of MP6 is also the emitter current of Q4 and is therefore an exponential current. The emitter of the fourth bipolar transistor Q4 is coupled to a mirror arrangement comprising two PMOS transistors MP6, and MP7. MP6 and MP7 mirror the emitter current of the fourth bipolar transistor Q4 and delivers it to the emitter of the first bipolar transistor Q1. Due to the collector current density difference between the first bipolar transistor Q1 and the second bipolar transistor Q2, a base emitter voltage difference, $\Delta V_{be}$, is developed across drain-source resistance $r_{on}$ of the load NMOS transistor MN1 which is operated in the triode region. The PTAT bias current from MN4 is mirrored by MP1 so that it flows into the emitter of the first bipolar transistor Q1, and is also mirrored by MP2 so that it flows into the emitter of the second bipolar transistor Q2. The emitter currents of the first bipolar transistor Q1 and the second bipolar transistor Q2 are unbalanced as emitter current of first bipolar transistor Q1 has two components, one having a PTAT form being derived from MP1 and one having an exponential form derived from MP7. The emitter current of the second bipolar transistor corresponds to the PTAT current from MN4. This imbalance between the emitter currents of the first and second bipolar transistors Q1 and Q2 corrects the second order reference voltage curvature error which would otherwise be evident at the output node ref.

It will be understood that what has been described herein are exemplary embodiments of circuits which have many advantages over the bandgap voltage reference circuits known heretofore. One such advantage which is derivable from the teaching to use a MOS transistor operating in the triode region is that circuits provided in accordance with the teaching of the invention are less sensitive to process variations compared to circuits implemented using resistors. A further advantage is that the circuit occupies less silicon area.

While the present invention has been described with reference to exemplary arrangements and circuits it will be understood that it is not intended to limit the teaching of the present invention to such arrangements as modifications can be made without departing from the spirit and scope of the present invention. In this way it will be understood that the invention is to be limited only insofar as is deemed necessary in the light of the appended claims.

It will be understood that the use of the term "coupled" is intended to mean that the two transistor s are configured to be in electric communication with one another. This may be achieved by a direct link between the two transistors or may be via one or more intermediary electrical transistors or other electrical elements.

Similarly the words "comprises" and "comprising" when used in the specification are used in an open-ended sense to specify the presence of stated features, integers, steps or components but do not preclude the presence or addition of one or more additional features, integers, steps, components or groups thereof.

I claim:

1. A bandgap voltage reference circuit comprising:

an amplifier having an inverting input, a non-inverting input and an output, first and second bipolar transistors operating at different collector current densities each associated with a corresponding one of the inverting and non-inverting inputs of the amplifier, a first load MOS transistor of a first aspect ratio being driven by the amplifier to operate in the triode region with a corresponding drain-source resistance $r_{on}$, the first load MOS device being operably coupled to the second bipolar transistor such that a base-emitter voltage difference ($\Delta V_{be}$) resulting from the collector current density difference between the first and second bipolar transistors is developed across the drain-source resistance $r_{on}$ of the first load MOS transistor, the voltage difference ($\Delta V_{be}$) being PTAT from drain to source;

a second load MOS transistor of the same type as the first load MOS transistor and with a second aspect ratio different than the first aspect ratio, such that the PTAT voltage developed across the first load MOS transistor is reflected with a gain across the second load MOS transistor, the gain voltage being PTAT from drain to source of the second load MOS transistor, from which a reference voltage is derived; and a cascoded MOS device of a second aspect ratio operably coupled to the first load MOS transistor and being driven by the amplifier to operate in the triode region.

2. A bandgap voltage reference circuit as claimed in claim 1, wherein the first and second aspect ratios are such that the drain-source voltage of the cascoded MOS device ($V_{ds}$) is a scaled representation of the base-emitter voltage difference ($\Delta V_{be}$).

3. A bandgap voltage reference circuit as claimed in claim 2, wherein the first aspect ratio is greater than the second aspect ratio.

4. A bandgap voltage reference circuit as claimed in claim 2, wherein the load MOS device comprises a plurality of unity MOS transistors coupled together in parallel.

5. A bandgap voltage reference circuit as claimed in claim 4, wherein the cascoded MOS device comprises at least one unity MOS transistor.

6. A bandgap voltage reference circuit as claimed in claim 4, wherein the load MOS device comprises four unity MOS transistors.

7. A bandgap voltage reference circuit as claimed in claim 2, wherein the circuit further comprises a feedback arrangement driven by the amplifier for biasing the first and second bipolar transistors, the load MOS device and the cascoded MOS device.

8. A bandgap voltage reference circuit as claimed in claim 7, wherein the circuit further comprises a diode configured MOS device coupled to the gates of the load MOS device and the cascoded MOS device.

9. A bandgap voltage reference circuit as claimed in claim 8, wherein the diode configured MOS device is located intermediate the cascoded MOS device and the feedback arrangement.

10. A bandgap voltage reference circuit as claimed in claim 7, wherein the feedback arrangement comprises a plurality of PMOS transistors.

11. A bandgap voltage reference circuit as claimed in claim 2, wherein the load MOS device is located intermediate the second bipolar transistor and the cascoded MOS device.

12. A bandgap voltage reference circuit as claimed in claim 11, wherein the drain of the load MOS device is coupled to the non-inverting input of the amplifier, and the source of the load MOS device is coupled to the emitter of the second bipolar transistor.

13. A bandgap voltage reference circuit as claimed in claim 2, wherein the emitter of the second bipolar transistor is directly coupled to the non-inverting input of the amplifier, and the base of the second bipolar transistor is coupled to a node intermediate the load MOS device and the cascoded MOS device.

14. A bandgap voltage reference circuit as claimed in claim 1, wherein the amplifier further comprises an inverting output and a non inverting output, the non-inverting output drives a first negative feedback gain loop, and the inverting output drives a second negative feedback gain loop.

15. A bandgap voltage reference circuit as claim in claim 14, wherein the gain provided by the first negative feedback gain loop is greater than the gain provided by the second negative feedback gain loop.

16. A reference voltage circuit as claimed in claim 1, wherein the circuit further comprises a compensation circuit for correcting curvature error.

17. A reference voltage circuit as claimed in claim 16, wherein the compensation circuit is configured for biasing one of the first and second bipolar transistors with current with exponential characteristics.

18. A bandgap voltage reference circuit comprising:

an amplifier having an inverting input, a non-inverting input and an output, first and second bipolar transistors operating at different collector current densities each associated with a corresponding one of the inverting and non-inverting inputs of the amplifier, a load MOS device comprising a plurality of unity MOS transistors coupled together in parallel and driven by the amplifier to operate in the triode region with a corresponding drain-source resistance $r_{on}$, the load MOS device being operably coupled to the second bipolar transistor such that a PTAT base-emitter voltage difference $\Delta V_{be}$ resulting from the collector current density difference between the first and second bipolar transistors is developed across the drain-source resistance $r_{on}$ of the load MOS device, the voltage difference ($\Delta V_{be}$) being PTAT from drain to source, and at least one cascoded MOS device being operably coupled to the load MOS device and comprising at least one unity MOS transistor and driven by the amplifier to operate in the triode region, the number of unity transistors in the first MOS device being such that the drain-source voltage of the second MOS transistor Vds2 is a scaled representation of the base-emitter voltage difference $\Delta V_{be}$.

19. A bandgap voltage reference circuit comprising:

an amplifier having an inverting input, a non-inverting input and an output, first and second bipolar transistors operating at different collector current densities each associated with a corresponding one of the inverting and non-inverting inputs of the amplifier, a load MOS device comprising a plurality of unity MOS transistors coupled together in parallel and driven by the amplifier to operate in the triode region with a corresponding drain-source resistance $r_{on}$, the load MOS device being operably coupled to the second bipolar transistor such that a PTAT base-emitter difference $\Delta V_{be}$ resulting from the collector current density difference between the first and second bipolar transistors is developed across the drain-source resistance $r_{on}$ of the load MOS device, the voltage difference ($\Delta V_{be}$) being PTAT from drain to source, and at least one cascoded MOS device being operably coupled to the load MOS device and comprising at least one unity MOS transistor and driven by the amplifier to operate in the triode region, the aspect ratio of each unity MOS transistor is such that the drain-source voltage of the second MOS transistor $V_{ds2}$ is a scaled representation of the base-emitter voltage difference $\Delta V_{be}$.

20. A bandgap voltage reference circuit comprising:

an amplifier having an inverting input, a non-inverting input, an inverting output, and a non-inverting output;

first and second bipolar transistors operating at different collector current densities each associated with a corresponding one of the inverting and non-inverting inputs of the amplifier;

a first MOS device driven by the non-inverting output of the amplifier and having a drain operably coupled to a second MOS device being in a diode configuration with a gate coupled to respective gates of a plurality of other MOS devices;

a load MOS device driven by the inverting output of the amplifier to operate in the triode region with a corresponding drain-source resistance $r_{on}$; and at least one cascoded MOS device being operably coupled to the load MOS device and driven by another one of the plurality of other MOS devices, the at least one cascoded MOS devices being operably coupled to a gate of a third bipolar transistor whose source is a reference voltage.

21. The bandgap voltage reference circuit of claim 20, wherein the amplifier has two feedback loops;

a first feedback loop is formed via the first MOS device, the second MOS device, and one of the plurality of other MOS devices that has a drain connected to the inverting input of the amplifier; and the second feedback loop is formed via the load MOS device and the second bipolar transistor associated with the inverting input of the amplifier.

22. The bandgap voltage reference circuit of claim 21, wherein the first feedback loop has a dominate gain.

23. A bandgap voltage reference circuit comprising:

an amplifier having an inverting input, a non-inverting input and an output;

first and second bipolar transistors operating at different collector current densities each associated with a corresponding one of the inverting and non-inverting inputs of the amplifier;

a first load MOS transistor of a first aspect ratio being driven by the amplifier to operate in the triode region with a corresponding drain-source resistance $r_{on}$, the first load MOS device being operably coupled to the second bipolar transistor such that a base-emitter voltage difference ($\Delta V_{be}$) resulting from the collector current density difference between the first and second bipolar transistors is developed across the drain-source resistance $r_{on}$ the first load MOS transistor, the voltage difference ($\Delta V_{be}$) being PTAT from drain to source;

a second load MOS transistor of the same type as the first load MOS transistor and with a second aspect ratio different than the first aspect ratio, such that the PTAT voltage developed across the first load MOS transistor is reflected with a gain across the second load MOS transistor, the gain voltage being PTAT from drain to source of the second load MOS transistor, from which a reference voltage is derived; and a third bipolar transistor for providing a CTAT voltage.

* * * * *